United States Patent [19]

Rassieur et al.

[11] 4,192,485

[45] Mar. 11, 1980

[54] DRILL RIG HOIST

[75] Inventors: Charles L. Rassieur; Richard R. Hesskamp, both of St. Louis, Mo.

[73] Assignee: Central Mine Equipment Company, St. Louis, Mo.

[21] Appl. No.: 918,478

[22] Filed: Jun. 23, 1978

Related U.S. Application Data

[63] Continuation of Ser. No. 749,158, Dec. 9, 1976, abandoned.

[51] Int. Cl.[2] ..... B66D 1/04

[52] U.S. Cl. ..... 254/187.5; 192/85 AA

[58] Field of Search ..... 254/187.1, 187.4, 187.5, 254/187.8, 186 R, 186 HC; 303/119; 188/265, 83, 71.1, 71.2, 18 A; 192/18 A, 85 AA

[56] References Cited

U.S. PATENT DOCUMENTS

| | | | |
|---|---|---|---|
| 2,497,603 | 2/1950 | Helstrom | 254/187.5 |
| 3,529,871 | 9/1970 | Burckhardt et al. | 303/119 |
| 3,966,024 | 6/1976 | Baer | 188/71.2 |

FOREIGN PATENT DOCUMENTS

| | | | |
|---|---|---|---|
| 1480132 | 5/1969 | Fed. Rep. of Germany | 188/71.1 |

*Primary Examiner*—Joseph F. Peters, Jr.
*Assistant Examiner*—D. W. Underwood
*Attorney, Agent, or Firm*—Polster, Polster and Lucchesi

[57] ABSTRACT

A drill rig hoist has a central shaft upon which a drum is mounted for free rotation. The shaft projects beyond the drum, and has at one end a caliper mounting plate secured to the shaft for rotation with the shaft. Clutch calipers mounted on the caliper mounting plate embrace a clutch rotor fixed to the drum. The drum also has a brake rotor mounted on it. Brake calipers, fixed to a base frame, embrace the brake rotor. The calipers are hydraulically operated, and an accumulator is provided in hydraulic lines to each of the brake and the clutch calipers.

7 Claims, 4 Drawing Figures

DRILL RIG HOIST

This is a continuation of application Ser. No. 749,158, filed Dec. 9, 1976, now abandoned.

BACKGROUND OF THE INVENTION

Among hoists used for placing and pulling drilling tools and pipe strings, there have been several conventional types, including the planetary clutch type with clutch and brake bands, the disc type clutch with band brakes, and the shoe type clutch, generally with a band brake. These prior art clutches have been satisfactory under proper conditions. However, they have had some disadvantages. Hoists of this sort are generally mounted on vehicles to permit their transport from one drill site to another. They are used in and exposed to all kinds of weather and temperature conditions. Even the enclosed types tend to corrode because of moisture and are difficult to repair in the field. The presence of water causes problems because they are not self-wiping. The enclosed types tend to heat and lose their effectiveness.

One of the objects of this invention is to provide an effective, relatively simple, rugged, easily maintained hoist system, which permits smooth operation and sensitive control.

Another object is to provide such a hoist system with built-in safety factors.

Other objects will become apparent to those skilled in the art in the light of the following description and accompanying drawings.

SUMMARY OF THE INVENTION

In a drill rig hoist connected to a power source, a central shaft, connected to the power source, is journaled for rotation. A drum, mounted for free rotation on the shaft, is so mounted that the shaft projects from at least one end, on which end a caliper mounting plate is secured to the shaft. Calipers, mounted on the caliper mounting plate have spaced, oppositely disposed friction elements embracing friction faces of a clutch rotor fixed to the drum for rotation with the drum. The caliper elements are actuated by fluid pressure supplied and controlled by manually operated means. An accumulator is positioned in the line between the source of the fluid pressure and the calipers, whereby the amount of pressure applied by the caliper elements to the clutch rotor is limited. The arrangement also makes for smooth and sensitive control. The clutch rotor and calipers can be exposed, because the calipers are self-wiping, and the heat dissipation characteristics of the system are excellent.

A set of calipers, fixedly mounted to a base frame, embrace a brake rotor secured to the hoist drum. These calipers are also actuated by fluid pressure, supplied and controlled by manually actuated means, and provided with an accumulator in the line between the source of fluid under pressure and the calipers. The brake accumulator serves not only to limit the amount of pressure applied by the calipers to the brake rotor, but to serve as a reverse source of fluid under pressure.

DESCRIPTION OF THE PREFERRED EMBODIMENT

Figure 1:
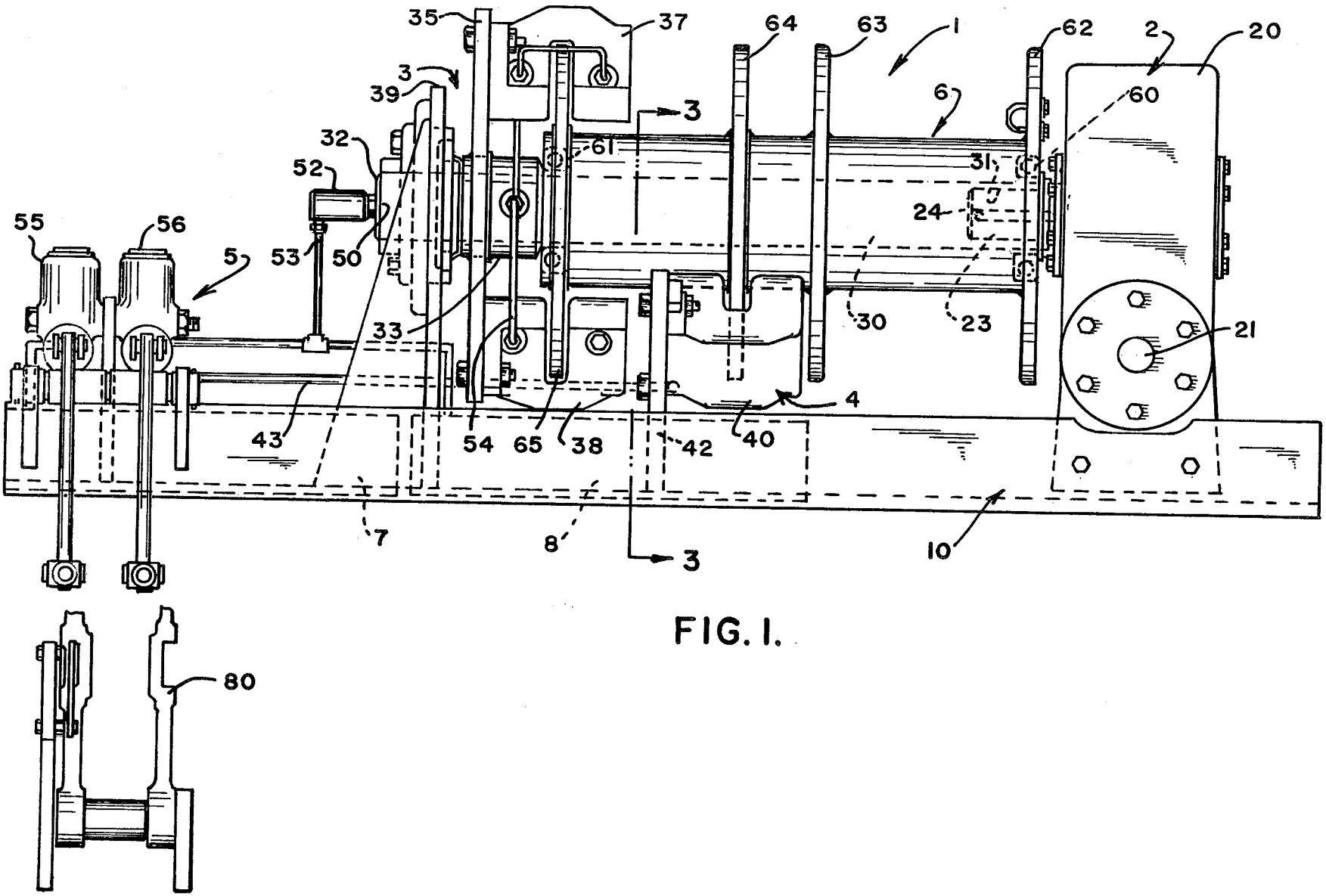
FIG. 1 is a view in side elevation, partly broken away, and in respect of an accumulator, partly diagrammatic, of one embodiment of hoist of this invention.

Referring now to the drawings for one illustrative embodiment of hoist of this invention, reference numeral 1 indicates a hoist assembly, with a power section 2, power transmission elements 3, a brake assembly 4 and controls 5.

The entire assembly is mounted on a heavy base frame 10, generally on a drill rig mounted on a truck or other heavy vehicle.

Figure 4:
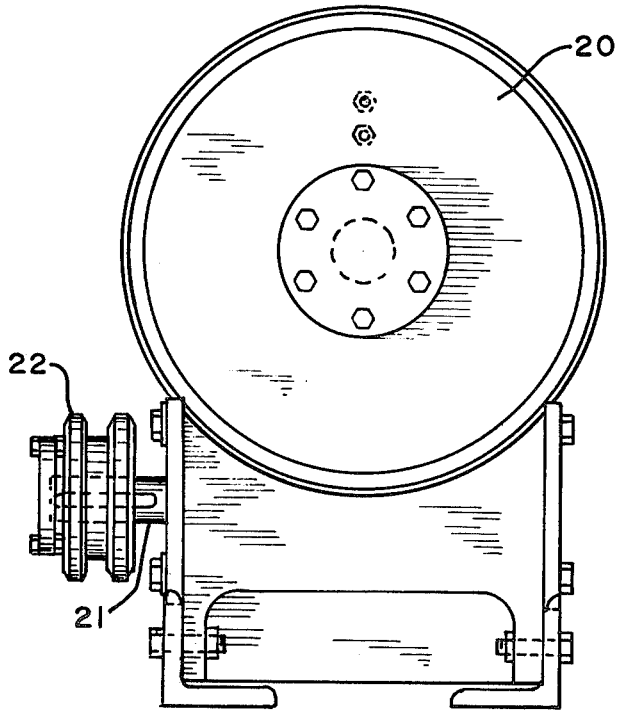
FIG. 4 is a view in end elevation as viewed from right to left in FIG. 1.

The power section 2 of the hoist assembly includes a gear box 20, mounted on the frame 10, with an input shaft 21 which, in this embodiment as shown particularly in FIG. 4, has a sprocket 22 keyed to it, and an output shaft 23, with a keyway or spline 24.

The input shaft 21 is connected to be driven by any suitable power source. While a chain drive is indicated by the sprocket in the embodiment shown in FIG. 4, the shaft can be driven directly through a suitable coupling. It may be and preferably is driven at constant speed.

A central shaft 30 is provided with a socket 31 in one end, into which the output shaft 23 extends and is keyed or splined to couple the two. The shaft 30 is journaled at its outer end in bearings supported by a stanchion 39, suitably braced and secured to the base frame 10. A hub 33 is secured to the shaft 30 inboard of the stanchion 39. A clutch caliper mounting plate 35 is secured to the shaft at the hub 33.

An outer end 32 of the shaft 30 projects beyond the bearing in which the shaft is journaled. An axial passage 50 in the shaft 30 extends from the outer end 32 to communicate with radial passages 51 in the shaft and hub 33. A gland 52, mounted against rotation, provides a rotary fluid-tight seal to complete communication between hydraulic piping 53 and the outer end of the passage 50.

A drum 6 is mounted for free rotation, on bearings 60 and 61, on the central shaft 30. The drum 6 in this embodiment has a spool flange 62 welded to it at one end, and another spool flange 63, which, with the flange 62, defines the line-receiving spool portion of the drum. The drum 6 also has welded to it a brake rotor 64 and a clutch rotor 65.

Calipers 37 and 38 are mounted on a side face of the caliper plate 35, in such a way as to embrace friction faces of the clutch rotor 65.

The calipers 37 and 38 are conventional, hydraulically operated, piston-type calipers with oppositely disposed friction elements, normally biased away from one another, and moving toward the rotor 65 in response to the supplying to them of hydraulic fluid under pressure.

They are connected to an accumulator 8 and a two-stage hydraulic clutch control cylinder 56 through the piping 53, to the gland 52, thence through the passage 50 and radial passages 51 to two branches of tubing 54 connected at one of their ends by suitable fittings to the ends of the radial passages 51 and, at their other ends, to the caliper cylinders.

The calipers 37 and 38 are located diammetrically opposite one another with respect to the rotor 65 and the caliper plate 35.

Figure 3:
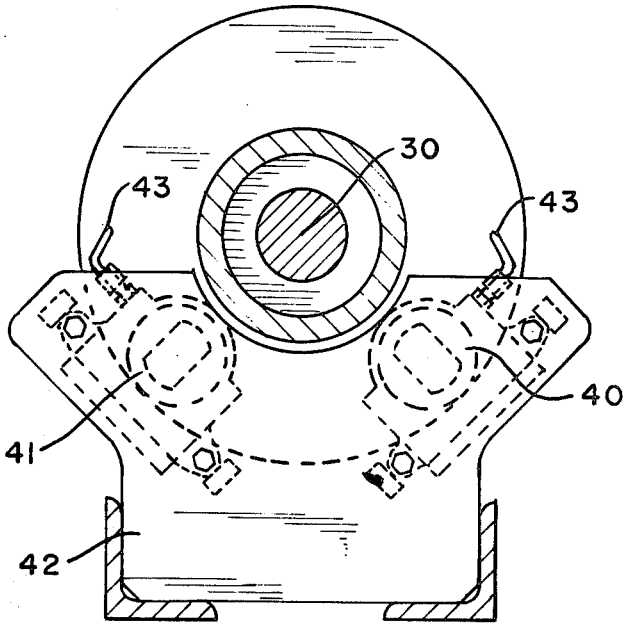
FIG. 3 is a sectional view taken along the line 3—3 of FIG. 1.

Brake calipers 40 and 41 are fixedly bolted to a plate 42 secured to the frame 10. As is shown most clearly in FIG. 3, they are symmetrically arranged, but at approximaterial 90° from one another with respect to the brake plate 63. The brake calipers 40 and 41 are connected by means of suitable tubing 43 to an accumulator 7 thence to a two-stage hydraulic brake control cylinder 55.

Figure 2:
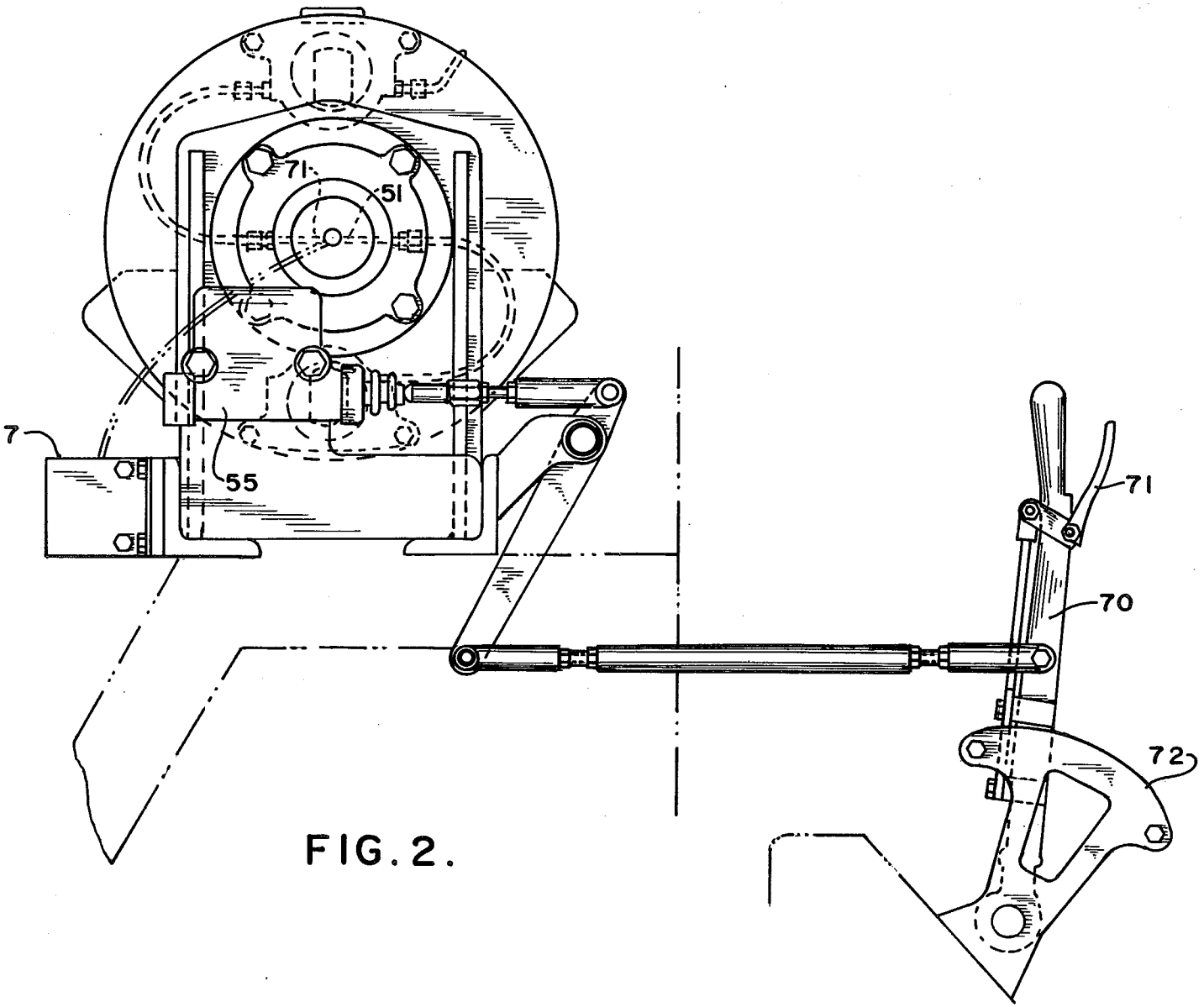
FIG. 2 is a view in end elevation as viewed from left to right in FIG. 1.

The brake control cylinder 55 is operated by a manually operated, ratcheting lever 70, connected by means of links and levers as shown in FIG. 2, to the control cylinder 55. The lever 70 has a ratchet handle 71 by which the lever 70 can be held in any desired position along a quadrant 72.

The clutch control cylinder 56 is operated by manually operated lever 80, connected through suitable links and levers like those shown in connection with the lever 70, to the control cylinder 56. However, there is no ratcheting arrangement in connection with the lever 80. There is thus no means for locking the clutch into engagement, which would be a safety hazard.

In operation, the shaft 30 is caused to rotate, by the rotation of the output shaft 23 of the power section 2. Assuming that the brake caliper is in its released condition, and that it is desired to turn the drum 6, to hoist a drilling tool from the ground, for example, the lever 80 is pulled back, causing hydraulic fluid under pressure to be delivered from the cylinder 56, through the piping 53, to the calipers 37 and 38, forcing the friction elements of the calipers into engagement with the clutch rotor 65. The calipers 37 and 38 are revolving with the caliper plate 35, and the engagement of the friction elements tends to cause the drum 6 to rotate with the calipers. The farther the lever 80 is moved, the greater the pressure applied to the friction elements, hence the rotor 65, until the drum rotates at the desired speed. The provision of the accumulator 8 ensures against breakage and damage to the hoist because, as determined by the setting of the accumulator, when the pressure generated by the cylinder 56 exceeds a given amount, the fluid in the system goes into the accumulator, thus limiting the amount of pressure. This can be set for any desired amount, and should be set at such a point that the hoist will not snap the cable or otherwise damage the equipment with which it is being used. The calipers have been found to provide a delicate touch in the control of the equipment. Operators using this system are provided a good feel for the control of the equipment.

When it is desired to hold the drum in a particular position or to control the paying out of cable, it is only necessary to apply the brake. As with the clutch, it is highly desirable to provide a brake which gives a satisfactory feel to the operator, because conventionally in this type of apparatus, it is desirable to have the drum free-spool in lowering tools or pipe into a well, the descent being controlled solely by the brake. The function of the accumulator in the brake system is chiefly to keep pressure in reserve. To that end, the amount of pressure supplied to the brake calipers is predetermined by the setting of the accumulator, and once that point is reached, fluid begins to go into the accumulator. This is preferably at about the halfway point in the travel of the lever 70. Thereafter, if, when the brake is set, there tends to be any pressure leakage, the fluid in the accumulator will make up for what would otherwise be a drop in pressure.

The accumulators 7 and 8 are essentially cylinders containing a spring loaded piston which is forced back against the bias of the spring to accumulate fluid in the cylinders. The two-stage power cylinders 55 and 56 are provided with double pistons, a larger one to move the brake and clutch calipers quickly into engagement and a smaller one to generate higher pressure with continued travel of the control levers. The calipers themselves can be standard heavy duty calipers.

The friction elements of the calipers and all of the other elements, are readily accessible, the entire assembly is compact compared with hoist assemblies known heretofore, the hoist is operable and effective in all sorts of weather and conditions of dirt and dust.

Numerous variations in the construction of the hoist of this invention, within the scope of the appended claims, will occur to those skilled in the art in the light of the foregoing disclosure. Merely by way of example, while the accumulators are of great value and are the preferred embodiment, their places can be taken by equivalent devices. In the case of the clutch, a by-pass arrangement can be used to limit the amount of pressure applied, although this will not provide the cushioning and nicety of control provided by the accumulator. In the case of the brake, a constantly running pump, supplying fluid from a reservoir of fluid to the hydraulic line at a predetermined pressure, particularly when the brake is fully activated, can be used, for example. Other shaft driving arrangements and, in the appropriate place, other bearing assemblies can be used, as well as different linkages in the manual controls. These are only illustrative.

Having thus described the invention, what is claimed and desired to be secured by Letters Patent is:

1. In a drilling rig hoist connected to a power source, the improvement comprising a central shaft, bearing means for supporting said shaft at one end for rotation about a central axis and means for coupling its other end to a power source, a caliper mounting plate secured to said shaft for rotation with said shaft, a plurality of caliper means mounted on and symmetrically about said caliper mounting plate, each of said caliper means having spaced, oppositely disposed friction elements arranged for movement toward and away from one another, a drum, mounted for rotation on and with respect to said central shaft and a clutch rotor fixed to said drum for rotation with it, said clutch rotor being positioned to extend between said friction elements, and fluid pressure means for actuating said caliper means.

2. The improvement of claim 1 including an accumulator in a fluid pressure line between said fluid pressure means and said caliper means for limiting the amount of fluid pressure to said caliper means.

3. The improvement of claim 1 including a brake rotor fixed to said drum, spaced axially of said drum from said clutch rotor, and a hydraulically operated brake caliper mounted on a fixed frame, said brake caliper having spaced, oppositely disposed friction elements arranged for movement toward and away from one another, said friction elements being positioned to bear on opposite radial friction surfaces of said brake rotor, and fluid pressure means for supplying hydraulic fluid to said brake caliper, said means including a source of pressure.

4. The improvement of claim 3 including an accumulator in a hydraulic fluid line between said source and said brake caliper.

5. The improvement of claim 1 wherein said fluid pressure means consists of a manually operated pressure cylinder.

6. The improvement of claim 2 wherein the fluid pressure means to said brake caliper includes a manually operated pressure cylinder.

7. The improvement of claim 4 wherein the fluid pressure means to said brake caliper includes a manually movable lever mechanically connected to said pressure cylinder, and said accumulator is set to accumulate fluid after an amount of travel of said lever substantially less than its full travel.

* * * * *